United States Patent [19]

Comfort

[11] Patent Number: 4,659,402

[45] Date of Patent: Apr. 21, 1987

[54] CROSS-LINKED DOUBLE BASE PROPELLANT HAVING IMPROVED LOW TEMPERATURE MECHANICAL PROPERTIES

[75] Inventor: Theodore F. Comfort, Cumberland, Md.

[73] Assignee: Hercules Incorporated, Wilmington, Del.

[21] Appl. No.: 860,422

[22] Filed: Dec. 14, 1977

[51] Int. Cl.[4] ..... C06B 45/10

[52] U.S. Cl. ..... 149/19.4; 149/19.8; 149/19.5

[58] Field of Search ..... 149/19.4, 19.8, 19.5

[56] References Cited

U.S. PATENT DOCUMENTS

| | | | |
|---|---|---|---|
| 3,711,343 | 1/1973 | Dunigan | 149/19.8 |
| 3,711,344 | 1/1973 | Pierce | 149/19.8 |
| 3,798,090 | 3/1974 | Allabashi | 149/19.4 |
| 3,956,890 | 5/1976 | Davis | 149/19.4 |
| 4,011,114 | 3/1977 | Allabashi | 149/19.4 |
| 4,038,115 | 7/1977 | Dehm | 149/19.8 |
| 4,052,943 | 10/1977 | Elrick | 149/19.4 |
| 4,234,364 | 11/1980 | Robinson | 149/19.8 |
| 4,462,848 | 7/1984 | Elrick | 149/19.8 |

*Primary Examiner*—Edward A. Miller

*Attorney, Agent, or Firm*—Michael B. Keehan

[57] ABSTRACT

Cross-linked double base propellants having improved low temperature mechanical properties are provided. The improved properties are achieved by using a mixture of polyglycoladipate and polycaprolactone as the binder prepolymer and employing a lacquer grade nitrocellulose containing 12.1% N to 12.6% N as the source of nitrocellulose.

6 Claims, No Drawings

CROSS-LINKED DOUBLE BASE PROPELLANT HAVING IMPROVED LOW TEMPERATURE MECHANICAL PROPERTIES

BACKGROUND OF THE INVENTION

This invention relates to cross-linked double base propellant compositions having improved low temperature strain properties at a high strain rate which propellants are suitable for use in tactical missiles.

Processes for preparation of cross-linked double base propellant are well known in the prior art. An illustrative prior art process for producing cross-linked double base propellant is described in U.S. Pat. No. 3,798,090 issued to John C. Allabashi, Mar. 19, 1974. This patent discloses the use of prepolymers of polyglycoladipate and tolylene diisocyanate as cross-linking agents for the nitrocellulose component of the propellant. This patent also discloses the use of certain prepolymers such as hydroxy-terminated polycaprolactones and aromatic and aliphatic diisocyanates as cross-linking agents for nitrocellulose.

Cross-linked double base XLDB propellants require good low temperature strain capability at very low temperatures in order to be of practical use in tactical missiles for such applications as air defense. In some rocket motors a propellant strain at maximum stress ($e_m$) value of 6% or more is desirable at −65° F. at a high strain rate (74 in./in./min/).

The low temperature strain capability of propellants is limited by the glass transition temperature of the propellant binder. The glass transition temperature of a propellant binder is dependent on the glass transition temperature and volume fractions of each of the binder components. In most XLDB propellants the binder consists of nitrocellulose, prepolymer such as polyglycol adipate, energetic plasticizer such as nitroglycerin, various stabilizers and a cross-linker.

The major ingredient of XLDB propellants is nitroglycerin which has a glass transition temperature −90° F. The glass transition termperature of XLDB propellant is higher than that of nitroglycerin due mainly to the higher glass transition temperature properties for the polymers included in the binder, viz., +248° F. for nitrocellulose and −38° F. for polyglycoladipate. Various approaches to lowering XLDB propellant binder glass transition temperature that have had limited success include lowering the nitrocellulose content and increasing the nitroglycerin level of the propellant. These approaches, however, result in lower propellant strength due to the lower polymer content in the propellant.

SUMMARY OF THE INVENTION

In accordance with this invention, a cross-linked double base propellant composition is provided, which propellant composition exhibits improved low temperature properties. The improved cross-linked double base propellants of this invention are based upon the discovery that improved XLDB low temperature properties can be achieved utilizing nitrocellulose containing from about 12.1% N to about 12.6% N as the nitrocellulose source for the propellant binder and employing polycaprolactone and polyglycoladipate as the binder prepolymer in place of polyglycoladipate alone.

DESCRIPTION OF THE INVENTION

The cross-linked double base propellant compositions of this invention contains from 0.1% to 10% nitrocellulose containing 12.1% to 12.6% nitrogen and from 5% to 25% binder prepolymer comprising a mixture of polyglycoladipate and polycaprolactone in which the weight ratio range of polyglycoladipate to polycaprolactone is from about 5 to 1 to about 1 to 5. The propellant composition can also contain from about 25% to about 75% oxidizer, 0 to about 20% metal fuel, about 10% to about 60% explosive nitroester plasticizer and minor amounts of stabilizers, ballistic modifiers and cross-linking agents.

Polyglycol adipate that can be employed in the propellant composition of this invention is a liquid having a molecular weight range of from about 1500 to about 4000 and is hydroxy terminated with a functionality between 1.9 and 4.0. Polyglycoladipates meeting the above chemical requirements are available commercially from Hooker Chemical Corporation, Witco Chemical Company, Incorporated, and Mobay Chemical Company.

Polycaprolactone which can be employed in the propellant composition of this invention has a molecular weight range of from about 500 to about 3000, is based on epsilon caprolactone, and has a functionality of about 2 to about 3. Polycaprolactone that can be employed has a melting point of about 60° C. and can be readily blended with nitrocellulose and polyglycoladipate. A suitable polycaprolactone which can be employed is available commercially from Union Carbide Corporation and is sold under the name NIAX® Polyol PCP.

The nitrocellulose which can be employed in the propellant composition of this invention is a lacquer grade or similar type nitrocellulose having a nitrogen content of from 12.1% to 12.6% and having a viscosity range as measured in solution as follows: for a solution of 20% nitrocellulose concentration a viscosity of 3 to 4 seconds to a viscosity for a 12.2% solution of 5 to 6.5 seconds. Viscosity is measured by the Falling Ball Method using as the solvent a mixture comprising by weight 20% ethyl acetate, 25% denatured ethyl alcohol and 55% toluene.

The following examples illustrate the cross-linked double base propellant compositions of this invention. In the examples and throughout the specification and claims, percentages are by weight unless otherwise stated.

EXAMPLE 1

A propellant composition of this invention is prepared as follows. Lacquer grade nitrocellulose containing 12.1% N, nitroglycerin, polyglycoladipate, polycaprolactone, and stabilizing agents are mixed together for three days at 140° F. to form a lacquer propellant premix. The lacquer propellant premix is transferred to a large mixer and cyclotetramethylenetetranitramine (HMX) is added to the premix in three equal increments and ballistic modifiers are added in one increment together with a curing catalyst. The slurry which results from addition of HMX solids and other solids to the propellant lacquer is mixed for five minutes at 110° F. after each increment of solids is added to the mixer. After all solids are added, the propellant slurry is mixed for one hour under a vacuum of <15 mm Hg at 90° F. Hexamethylene diisocyanate (cross-linking agent) is added to the propellant slurry and the slurry is vacuum mixed for 20 additional minutes at 90° F. at a vacuum of <15 mm Hg. The propellant is then cast into the desired molds and cured for ten days at 120° F.

EXAMPLES 2–5

The mixing procedure illustrated in Example 1 above is repeated to prepare propellant compositions with varying amounts of binder prepolymer and the resulting propellants are tested at 74 in./in./min. strain rate at 77° F. and −65° F. The results of this testing are set forth in Table I. Examples 2*a*, 3*a* and 4*a* are control examples in which the propellant does not contain polycaprolactone in the binder prepolymer. Examples 2*b*, 3*b*, 4*b* and 4*c* are propellant compositions of this invention and are set forth for direct comparison with examples 2*a*, 3*a* and 4*a*, respectively. Examples 5*a* and 5*b* show the effect of the ratio of polyglycoladipate to polycaprolactone on the strain properties of the resulting propellant at −65° F. and at a high strain rate.

TABLE I

| Example | 2(a) | 2(b) | 3(a) | 3(b) | 4(a) | 4(b) | 4(c) | 5(a) | 5(b) |
|---|---|---|---|---|---|---|---|---|---|
| Composition, Wt. % | | | | | | | | | |
| Binder | | | | | | | | | |
| NC[2] | 1.62 | 1.62 | 1.54 | 1.62 | 1.25 | 1.22 | 1.22 | 1.57 | 1.57 |
| PGA[3] | 7.89 | 6.31 | 7.69 | 6.31 | 7.50 | 5.82 | 4.26 | 6.26 | 4.69 |
| PCP[4] | — | 1.58 | — | 1.58 | — | 1.50 | 3.00 | 1.57 | 3.14 |
| NG[5] | 30.90 | 30.90 | 30.50 | 30.90 | 30.95 | 31.16 | 31.15 | 29.73 | 29.71 |
| Stabilizers & Cross-linker | 1.39 | 1.39 | 1.62 | 1.35 | 2.10 | 2.10 | 2.17 | 2.67 | 2.69 |
| Nitramine (Oxidizer) | 56.00 | 56.00 | 56.00 | 56.00 | 56.00 | 56.00 | 56.00 | 56.00 | 56.00 |
| Ballistic Modifiers | 2.20 | 2.20 | 2.70 | 2.20 | 2.20 | 2.20 | 2.20 | 2.20 | 2.20 |
| Strain Rate At 74 In./In./Min. & 77° F. | | | | | | | | | |
| Modulus, psi | 450 | 395 | 440 | 223 | 407 | 315 | 280 | 300 | 420 |
| Tensile, psi | 156 | 149 | 137 | 94 | 148 | 124 | 125 | 133 | 148 |
| Strain at max. stress, % | 139 | 131 | 140 | 156 | 147 | 145 | 135 | 104 | 76 |
| Tear strength, psi | 44 | 41 | — | — | — | — | — | — | — |
| Strain Rate At 74 In./In./Min. & −65° F. | | | | | | | | | |
| Strain at max. stress, % | — | — | 12 | 21 | 13.8 | 16.7 | 20.8 | 15.7 | 19.6 |
| Strain at break, % | — | — | 14.5 | 57 | 27.4 | 28.7 | 40.8 | — | 27.5 |
| Strain Rate At 74 In./In./Min. & −65° F. | | | | | | | | | |
| Strain at max, stress, % | 19 | 25 | 19 | — | — | — | — | 18.2 | — |
| Strain at break, % | 40 | >105 | 40 | — | — | — | — | — | — |

[2]NC (nitrocellulose), lacquer grade - 12.1% N, equivalent weight 370.
[3]PGA (polyglycoladipate), hydroxyl functionality 2.7, equivalent weight 900.
[4]PCP (polycaprolactone), hydroxyl functionality 2.0, equivalent weight 1000.
[5]NG is nitroglycerin (contains nitrodiphenylamine stabilizer).

In exmple 2*b* about 20% by weight of the polyglycoladipate of example 2*a* was replaced by polycaprolactone. The −65° F. strain at maximum stress for the propellant of example 2*b* increased from 19% to 25% and the strain at break increased from 40% to greater than 105%.

In example 3*b*, about 20% of the polyglycoladipate of example 3*a* was replaced with polycaprolactone. Strain at maximum stress at −65° F. for the propellant of example 3*b* increased from 12% to 21% over the propellant of example 3*a* and the strain at break increased from 14.5% to 57%.

In examples 4*b* and 4*c* polyglycoladipate was replaced by varying amounts of polycaprolactone. Strain at maximum stress and strain at break increased with increasing concentrations of polycaprolactone in the propellants of Examples 4*b* and 4*c* as compared to the control propellant, example 4*a*.

EXAMPLES 6–9

Four propellants are prepared following the mixing procedure of Example 1. Examples 6 and 7 represent prior art propellants. Examples 8 and 9 are propellants of this invention. Examples 8 and 9 exhibit both high strain capabilities at −65° F. and lower glass transition temperatures (Tg, °F.) than the prior art propellants. The propellant compositions, strain at maximum stress and glass transition temperature data are set forth in Table II.

TABLE II

| Example | 6 | 7 | 8 | 9 |
|---|---|---|---|---|
| Composition, Wt % | | | | |
| NC[2] | 5.45 | 1.58 | 1.62 | 1.62 |
| PGA[3] | 5.45 | 7.88 | 6.31 | 6.31 |
| PCP[4] | — | — | 1.58 | 1.58 |
| NG/NDPA[5] | 40.35 | 31.35 | 31.31 | 31.35 |
| Cross-linker | 1.05 | 0.99 | 0.94 | 0.90 |
| Nitramine (oxidizer) | 45.00 | 56.00 | 56.00 | 56.00 |
| Ballistic Modifiers | 2.70 | 2.20 | 2.20 | 2.20 |
| Test Results | | | | |
| Strain Rate At 74 in./in./min. & −65° F. | | | | |
| Strain at max stress, % | 9 | 11 | 25 | 21 |
| Tg, °F. (Calculated)[6] | −58 | −67 | −70 | −70 |

[2]NC (nitrocellulose), lacquer grade - 12.1% N equivalent weight = 370.
[3]PGA (polyglycoladipate), hydroxyl functionality = 2.7, equivalent weight = 900.
[4]PCP (polycaprolactone), hydroxyl functionality = 2.0, equivalent weight = 1000.
[5]NG is nitroglycerin (contains nitrodiphenylamine stabilizer)
[6]Tg is calculated from Kelly-Bueche equation.

The propellant compositions of this invention as described above can contain various oxidizers, energetic nitroester plasticizers, fuels, cross-linking agents, stabilizers and other components commonly employed in XLDB propellant compositions. Thus, the propellant compositions of this invention can contain organic or inorganic oxidizing agents and mixutres thereof such as cyclotetramethylenetetranitramine (HMX), cyclotrimethylenetrinitramine, ammonium perchlorate, sodium perchlorate and the like; metal fuels such as particulate aluminum; energetic nitroester plasticizers such as nitroglycerin, diethyleneglycol dinitrate, triethylolethane trinitrate and the like; cross-linking agents such as hexamethylene diisocyanate; toluene diisocyanate; isophorone diisocyanate; and lysine diisocyanate; and any of the stabilizers and ballistic modifiers commonly employed in cross-linked double base propellants.

What I claim and desire to protect by Letters Patent is:

1. In a crosslinked composite modified double base propellant composition comprising nitrocellulose, energetic nitoester plasticizer, organic or inorganic oxidizing agents and mixtures thereof, binder prepolymer and isocyanate crosslinking agents, the improvement comprising employing, lacquer grade nitrocellulose containing 12.1% to 12.6% nitrogen as the nitrocellulose source, and employing a mixture comprising polyglycoladipate having a hydroxyl functionality of 1.9 to 4.0 and polycaprolactone having a hydroxyl functionality of about 2 to about 3 in which the weight ratio of polyglycoladipate to polycaprolactone is about 5 to 1 to about 1 to 5 as the binder prepolymer, the percent by weight of nitrocellulose being from about 0.1% to about 10% and the weight of the binder prepolymer being from about 5% to about 25%, based on the weight of the propellant composition.

2. The improved cross-linked double base propellant of claim 1 in which the polycaprolactone has a hydroxyl functionality of about 2.

3. The improved cross-linked double base propellant of claim 1 in which the nitrocellulose contains 12.1% N and has a viscosity of 3 to 4 seconds as a 20% solution measured by the Falling Ball Method using as a solvent for said nitrocellulose a mixture comprising by weight 20% ethyl acetate, 25% denatured ethyl alcohol and 55% toluene.

4. The improved cross-linked double base propellant of claim 1 in which the nitrocellulose contains 12.1% N and has a viscosity of 5 to 6 seconds as a 12.2% solution measured by the Falling Ball Method using as a solvent for said nitrocellulose a mixture comprising by weight 20% ethyl acetate, 25% denatured ethyl alcohol and 55% toluene.

5. The improved cross-linked double base propellant of claim 2 in which the nitrocellulose contains 12.1% N and has a viscosity in the range between 3 to 4 seconds as a 20% solution and 5 to 6 seconds as a 12.2% solution, said viscosity being measured by the Falling Ball Method using as a solvent for said nitrocellulose a mixture comprising by weight 20% ethyl acetate, 25% denatured ethyl alcohol and 55% toluene.

6. The improved cross-linked double base propellant of claim 5 in which the polyglycoladipate has a hydroxyl functionality of about 2.7.

* * * * *